US005249569A

United States Patent [19]

Wohler

[11] Patent Number: 5,249,569

[45] Date of Patent: Oct. 5, 1993

[54] PHARYNGO-LARYNGEAL COMPOUND SPECULUM

[76] Inventor: W. H. Wohler, 1202 N. Bell, San Angelo, Tex. 76903

[21] Appl. No.: 729,038

[22] Filed: Jul. 12, 1991

[51] Int. Cl.[5] ..... A61D 1/00

[52] U.S. Cl. ..... 128/19; 128/10

[58] Field of Search ..... 128/14, 12, 10, 19, 128/17, 18

[56] References Cited

U.S. PATENT DOCUMENTS

| | | | |
|---|---|---|---|
| 803,418 | 10/1905 | Hineman | 128/19 |
| 2,920,616 | 1/1960 | Girerd | 128/12 |
| 3,550,584 | 12/1970 | Ring | 128/12 |
| 3,568,664 | 3/1971 | Meriwether | 128/14 |

FOREIGN PATENT DOCUMENTS

| | | | |
|---|---|---|---|
| 587727 | 10/1933 | Fed. Rep. of Germany | 128/14 |
| 8501435 | 4/1985 | PCT Int'l Appl. | 128/19 |
| 1181658 | 9/1985 | U.S.S.R. | 128/14 |

*Primary Examiner*—Richard J. Apley
*Assistant Examiner*—Karen Jalbert
*Attorney, Agent, or Firm*—Wendell Coffee

[57] ABSTRACT

A pharyngo-laryngeal compound speculum includes a mouth speculum having a pole strap and two bars which may be inserted into the mouth of an animal and moved to open the mouth of the animal. One of the bars is rotatable and a guide ring is mounted on the rotatable bar. A cylindrical, tubular speculum may be inserted through the guide ring for visualization of the larynx and to gain access to passages for instruments through the tubular speculum into the larynx and the lower reaches of the trachea and bronchi to gain specimens and administer treatments. Also, the same instruments result in the visualization and the access to the opening of the esophagus of animals allows passage of instruments into the esophagus.

1 Claim, 4 Drawing Sheets

PHARYNGO-LARYNGEAL COMPOUND SPECULUM

BACKGROUND OF THE INVENTION

Field of the Invention

This invention relates to veterinary instruments and more particularly to a mouth speculum for opening the mouth of domestic animals combined with a cylindrical speculum for pharyngo-laryngeal visualization and related procedures. Veterinarians have ordinary skill in this art.

Description of the Related Art

Mouth speculums of this nature are well known. However, it is difficult to operate the mouth speculum and simultaneously depress the tongue to inspect, treat or take samples from the remote portions of the pharynx and larynx. It is particularly difficult to pass instruments through the larynx into the trachea and bronchi. While it is not as difficult to pass instruments into the esophagus, this instrument is also useful in passing instruments into the esophagus.

SUMMARY OF THE INVENTION

Progressive Contribution to the Art

I have devised a compound speculum consisting of two principal parts, vis. a mouth speculum for opening the mouth in which is incorporated a guide ring or aperture; and a cylindrical speculum which may be passed through the guide ring, over the tongue, and into the pharynx. The cylindrical speculum is tubular.

The guide ring is mounted on a pivoting rod or fulcrum. The guide ring provides a degree of stabilization yet may be rotated adequately by the fulcrum for sufficient movement of the cylindrical speculum for the operator to be able to visualize the posterior of the pharynx, the larynx, and the opening of the esophagus and allow treatment to these areas and the acquisition of specimen samples from these areas. The cylindrical speculum so guided also facilitates the passage of instruments into and through the larynx and on into the trachea and bronchi or for the passage of instruments into the esophagus as may be desired.

Objects of this Invention

An object of this invention is the visualization of and access to the pharynx and larynx, and the opening of the esophagus of animals.

Another object of this invention is to conveniently visualize the larynx and gain access to passage of sampling instruments through the larynx and on into the lower reaches of the trachea and bronchi in order to obtain specimens for microbiological, histological and immuno-chemical testing and evaluation. Use of such equipment and procedures is of extreme importance in the treatment and management of the respiratory disease of stocker and feeder cattle which is commonly known as Shipping Fever.

Further objects are to achieve the above with devices that are sturdy, compact, durable, lightweight, simple, safe, efficient, versatile, ecologically compatible, energy conserving, and reliable, yet inexpensive and easy to manufacture, operate, and maintain.

Other objects are to achieve the above with a method that is rapid, versatile, ecologically compatible, energy conserving, efficient, and inexpensive, and does not require highly skilled people to operate, and maintain.

The specific nature of the invention, as well as other objects, uses, and advantages thereof, will clearly appear from the following description and from the accompanying drawings, the different views of which are not necessarily scale drawings.

Figure 1:
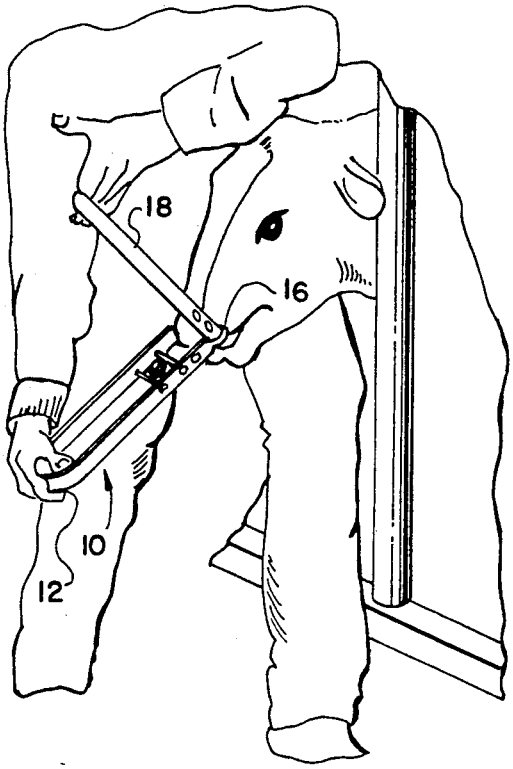
FIG. 1 illustrates a mouth speculum according to this invention before inserting into the animal's mouth.
Figure 2:
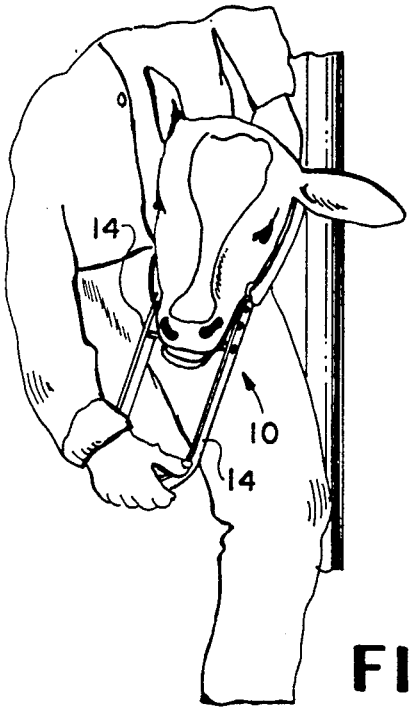
FIG. 2 illustrates the speculum in the mouth.

As an aid to correlating the terms of the claims to the exemplary drawing(s), the following catalog of elements and steps is provided:

| | |
|---|---|
| 10 | mouth speculum |
| 12 | bight |
| 14 | legs |
| 16 | pole strap ring |
| 18 | pole strap |
| 20 | fulcrum |
| 22 | bolster |
| 24 | projection |
| 25 | extension |
| 26 | hole, intermediate |
| 27 | snap washer |
| 29 | distal hole |
| 30 | guide ring |
| 31 | proximal hole |
| 32 | cylindrical speculum |
| 110 | mouth speculum |
| 116 | pole strap ring |
| 120 | fulcrum |
| 122 | bolster |
| 126 | intermediate hole |
| 132 | tongue depressor |
| 210 | mouth speculum |
| 214 | legs |
| 220 | fulcrum |
| 221 | plate |
| 222 | bolster |
| 230 | guide |
| 310 | mouth speculum |
| 314 | legs |
| 316 | pole strap ring |

-continued

| | |
|---|---|
| 320 | fulcrum |
| 322 | bolster |
| 324 | notched washer |
| 326 | notch |
| 328 | pin |
| 410 | mouth speculum |
| 414 | legs |
| 416 | pole strap ring |
| 420 | fulcrum |
| 422 | bolster |
| 424 | snap pin |
| 425 | pin stop |
| 427 | washer |
| 429 | distal hole |
| 430 | guide ring |
| 431 | proximal hole |
| 432 | notch |

DESCRIPTION OF THE PREFERRED EMBODIMENTS

In order to fulfill the mandates of Article 1 § 8 of the U.S. Constitution, a description of the invention is presented now.

Referring to FIGS. 1–7 there may be seen mouth speculum 10 according to this invention. The speculum includes an inverted U-shaped frame which includes bight 12, and two legs 14 extending from the bight to distal ends. Each distal end includes pole strap ring 16 to which pole strap 18 may be attached.

Transverse fulcrum 20, in the form of a rod, extends between the legs 14. The fulcrum 20 is near the distal end of the legs in FIGS. 1–4, 6 and 7. Transverse bolster 22, also in the form of a rod, extends between the legs 14. The bolster is located between the fulcrum 20 and the bight 12 in FIGS. 1–4, 6 and 7. Those having skills in the veterinary arts will understand that the invention as described to this point is old and well known to the art. In use, as seen in FIGS. 1–5, the pole strap 18 is placed behind the pole of the animal's head.

Figure 3:
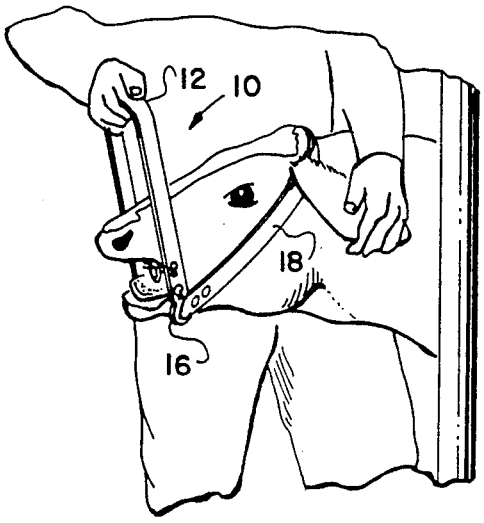
FIG. 3 shows the mouth speculum opening the animal's mouth.
Figure 4:
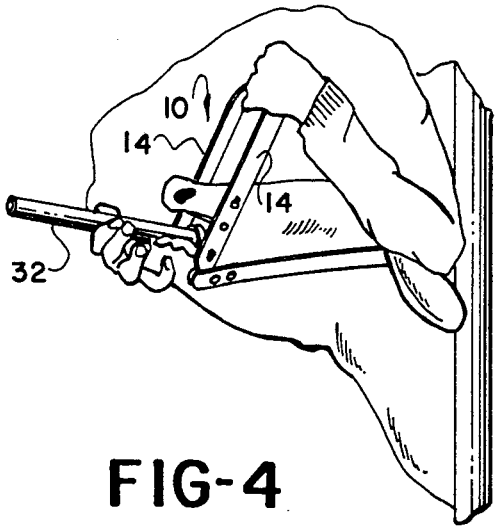
FIG. 4 shows the mouth speculum, with a cylindrical speculum through the guide ring of the mouth speculum in an animal's open mouth.
Figure 7:
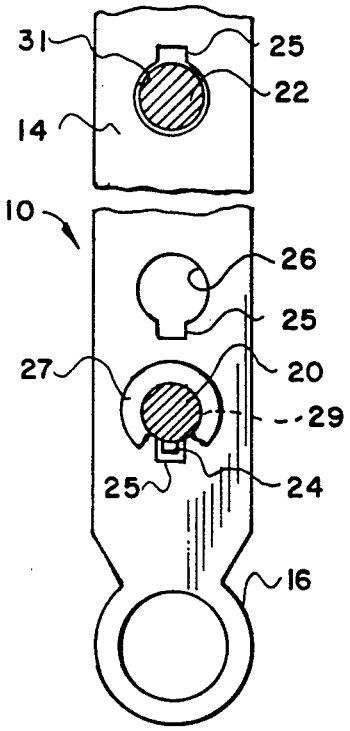
FIG. 7 is a sectional view of the distal portion of one of the legs of the speculum, taken on line 7—7 of FIG. 6.

The strap is adjustable in length by a buckle (not shown). Then with the legs 14 generally aligned with the mouth of the animal, the fulcrum 20 and the bolster 22 are inserted into the mouth, FIG. 1. The strap 18 shortened by the buckle so that the speculum 10 is held in place with the pole strap 18 behind the pole of the animal's head, FIG. 2. Using the fulcrum 20 against the lower jaw of the animal and with the hand on the bight 12, the speculum is rotated to a position transverse of the animal's mouth as seen in FIG. 3. Use of speculums for opening the mouth of animals to this point is well known.

It will be understood that a speculum of this nature may be used upon any animal having an elongated upper and lower jaw with a well defined interdental space and a defined pole for the operation of the pole strap. Such animals include the equine, bovine, and canine, for example.

According to the preferred form of my invention as seen in FIGS. 1 through 4, 6, and 7; the fulcrum 20 is rotatably pivoted to the legs by the simple expedient of holes in the legs and the length of the fulcrum extending through the legs at these holes. The degree of rotation is limited by projection 24 attached to the rod forming the fulcrum 20 at the point where the fulcrum extends through the hole 26 in each of the legs 14. The hole 26 is key-hole shaped with extension 25. The extension 25 is larger than the pin or projection 24 within the extension 25. It is so arranged and constructed that the fulcrum can pivot either 15 degrees clockwise or counter-clockwise as limited by the pin attached to the fulcrum which passes through the keyhole.

The fulcrum 20 is held in position to the legs by a snap ring washer 27 fitting into a groove (not shown) on each side of the leg 14. The bolster 22 is also held in place by snap rings 27 within grooves on the outside of the legs 14. The bolster is free to rotate, although this is not necessary.

Guide ring 30 is attached to the fulcrum 20 approximately medially thereof. The guide ring 30 would lie in the same plane as the plane of the mouth speculum 10 when the fulcrum was in its medial position, i.e., the projection 24 was centered within the extension 25.

Cylindrical speculum 32 is tubular with an outside diameter slightly smaller than the inside diameter of the guide ring 30 through which it is telescoped. The cylindrical speculum is passed over the tongue and into the pharynx thus allowing the operator to visualize the posterior portions of the pharynx and the larynx. The cylindrical speculum also serves as a protective guide for the passage of instruments for purposes such as the taking of specimen samples for laboratory analysis from the posterior pharynx, the larynx and by passage of instruments through the larynx also from the trachea and bronchi, and for the visualization via endoscopic procedures of the trachea and bronchi and the treatment of these various anatomical areas and structures.

Figure 8:
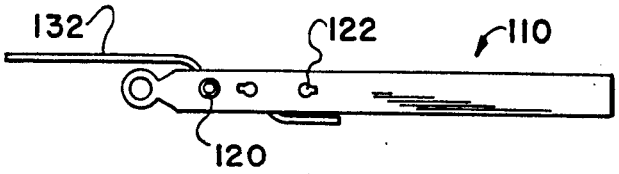
FIG. 8 is a side elevational view of a second embodiment of a speculum having a tongue depressor.
Figure 9:
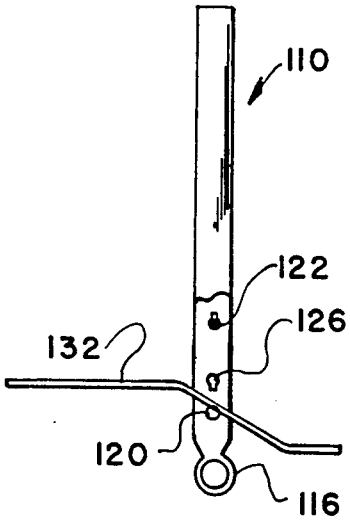
FIG. 9 is a side elevation, partially broken away, of the speculum according to the embodiment of FIG. 8 with the tongue depressor in a different position.

As illustrated in FIGS. 8 and 9, in certain instances if an operator did not wish to use a detachable cylindrical speculum, tongue depressor 132 is permanently attached as by welding to fulcrum 120 of a second embodiment of a speculum 110. It will be seen from FIGS. 8 and 9 and their comparison to FIGS. 6 and 7, that other than using a permanently affixed tongue depressor, there is little difference between the mouth speculum 10 and mouth speculum 110. The bolster 122 will limit the rotation of the tongue depressor to less than 180°. Inasmuch as there is no reason to limit the rotation of the tongue depressor to a small arc, there is no necessity for having the projection 24.

Also, it may be seen that the mouth speculum of FIGS. 1–7, has an additional distal hole 29 which show that the fulcrum 20 may be placed closer to the distal end. This is to be used in the event that the mouth of the animal is to be opened wider. This would occur with larger calves than are shown in FIGS. 1–4, and in certain instances it is desirable to open the calf's mouth wider. The additional distal hole is shown in FIGS. 8 and 9 but not numbered.

Figure 5:
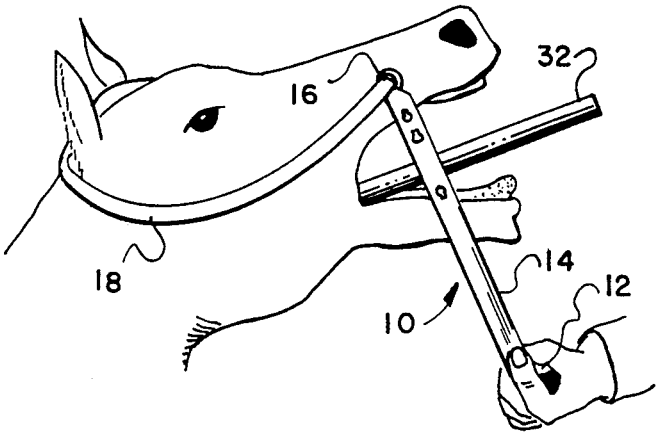
FIG. 5 shows the compound speculum in use with a larger animal, such as an equine as shown.
Figure 6:
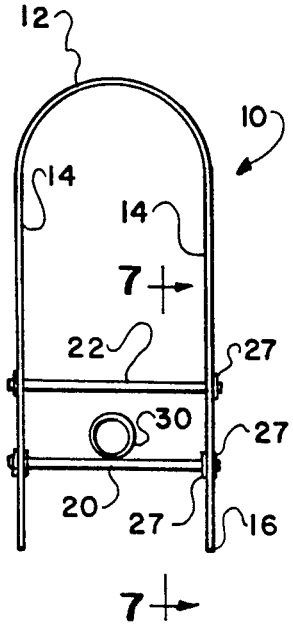
FIG. 6 is a front elevational view of the speculum of FIGS. 1, 2, 3, and 4.

Also, referring to FIG. 5, in certain cases, for example with horses where the animal is taller, it is desirable to have the fulcrum through the proximal hole 31. As illustrated in FIGS. 1–4, the bolster is inserted through the proximal hole 31. However, with horses which are taller, it is desired to place the fulcrum through the hole 31 and the bolster through the hole 29 which is closer to the distal end, FIG. 5. This achieves two purposes, (1) that the mouth of the horse is opened wider, and (2) with this arrangement the bight 12 can be placed below the lower jaw which results in a more convenient position for the veterinarian or other operator to open the mouth of the horse. It will be understood that with the head of the horse standing up higher, it is more difficult to have the bight 12 extend over the upper jaw of the horse and it is better to have it extend below the lower jaw and since the guide ring 30 is on the fulcrum 20 it is oriented better if the fulcrum 20 is moved to the hole 31.

For this reason the extension 25 of the hole 31 extends toward the bight 12 rather than toward the distal end as in the case of hole 26 and 29. In each instance the guide ring 30 will be located between the fulcrum 20 and the bolster 22 so that it is in better position for use with the cylindrical speculum 32.

Figure 10:
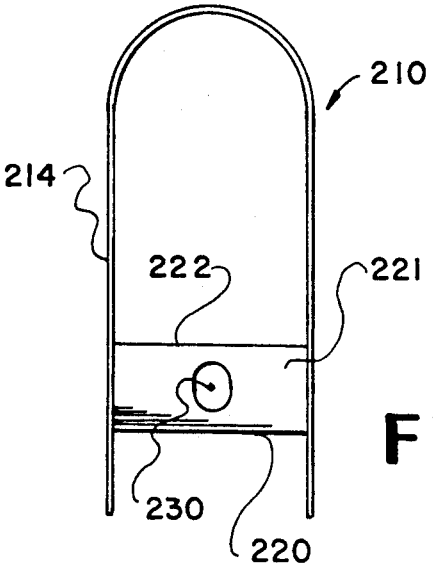
FIG. 10 is a front elevational view of a third embodiment.

FIG. 10 shows yet another embodiment in the form of mouth speculum 210. In this case the fulcrum and bolster are combined into single plate 221 with the distal edge functioning as fulcrum 220 or distal bar and the upper edge functioning as bolster 222 or proximal bar. The entire plate 221 is readily attached as by welding to the legs 214 of this embodiment. The guide 230 in this instance is in the form of an elongated aperture so that a tube such as tube 32 may be inserted through the elongated aperture 230 and have a restricted pivoting motion due to the elongation of the aperture as seen in the drawing of FIG. 10.

As may be seen in FIG. 10 the aperture 230 is elongated in a direction aligned with the legs of the mouth speculum. This elongation permits the tube or cylindrical speculum 32 to be moved in a dorsoventral plane so that the cylindrical speculum can be directed to either the esophagus or the larynx. This is the same angling as achieved in the embodiment of FIG. 1 through 7 by the limited rotation of the fulcrum 20 when the cylindrical speculum 32 is inserted through the guide ring 30.

Figure 11:
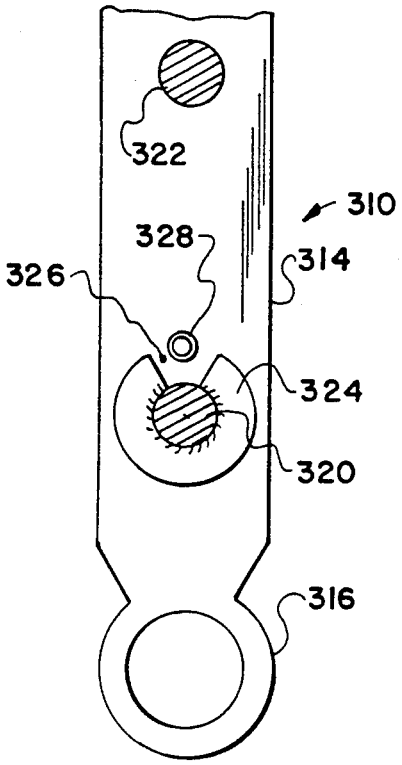
FIG. 11 is a sectional view similar to FIG. 7 of the distal portion of one of the legs of the speculum showing another embodiment.

FIG. 11 is an alternate manner of attaching the bolster and the fulcrum. As seen there illustrated, is a mouth speculum 310 which has one of the legs 314 illustrated and the pole strap ring 316. The bolster 322 in this case, may well be welded to the leg 314, or held in place by snap rings or other conventional means.

The degree of rotation is limited by washer 324 attached as by welding to each end of the fulcrum 320, adjacent either to the interior surface or the exterior surface of the leg 314. Washer 324 is notched at 326 for a small arc. Pin 328, in the form of a conventional roll pin, extends through the leg 314 at the washer. The notch has an arc 30° greater than the portion of the arc occupied by the diameter of the pin 328. I.e., from the position where the pin 328 is centered within the notch the fulcrum can pivot 15° either clockwise or counterclockwise. Therefore it may be seen that likewise a cylindrical speculum inserted through the ring 430 may be pivoted to different dorsoventral angles.

Figure 12:
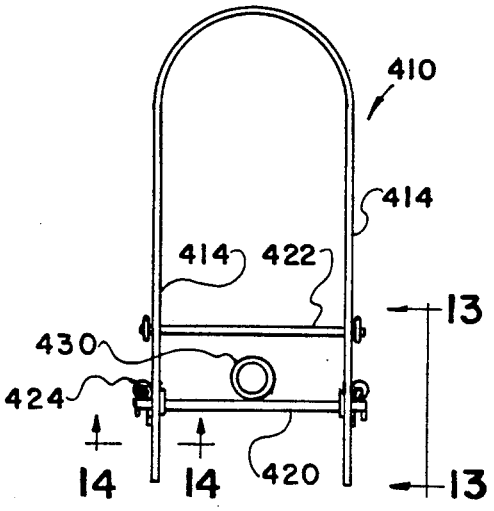
FIG. 12 is a front elevational view of a speculum showing yet another embodiment.
Figure 13:
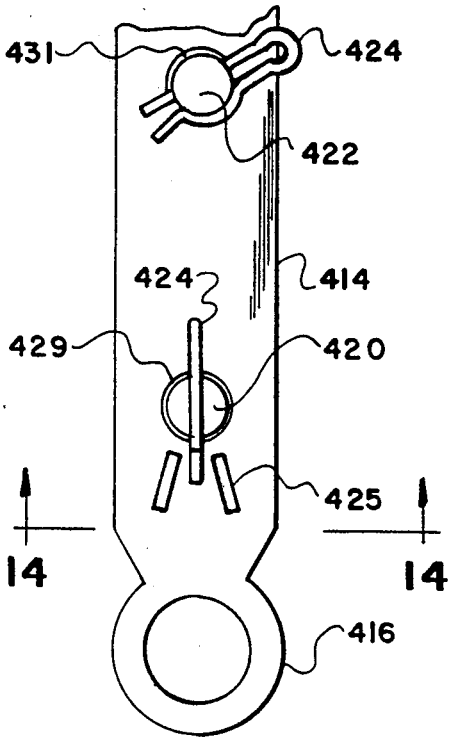
FIG. 13 is a side elevational view of the embodiment of FIG. 12.
Figure 14:
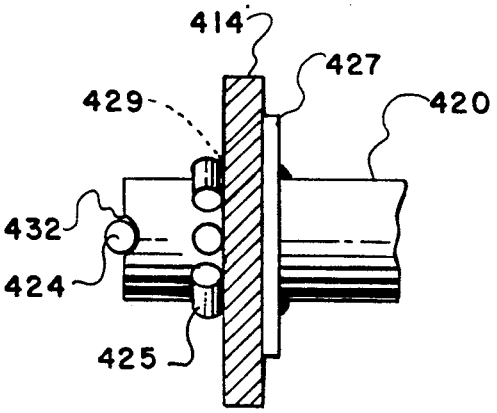
FIG. 14 is a sectional view taken substantially on line 14—14 of FIG. 12 and FIG. 13 showing details of construction of the embodiment of FIG. 12.

Referring to FIGS. 12, 13, and 14, there may be seen a mouth speculum 410 having legs 414 with a pole strap ring 416. Fulcrum 420 extends through the distal holes 429 in the legs 414. Washer 427 is attached as by welding to the fulcrum 420 adjacent the legs on the interior side of the legs 414. The fulcrum is held in place by snap pins 424 extending through holes in the ends of the fulcrum 420 which protrude outside the legs 414. The holes through which the snap pins 424 extends lie in the same plane as the guide ring 430 which is attached by welding to the mid-point of the fulcrum. Snap pins are held in the same plane as the guide ring 430 by a notch 432 which is in the ends of the fulcrum 420. The notch 432 is particularly seen in FIG. 14. Pin stops 425 are attached as by welding to the outside legs 414 so that they cooperate with the leg of the snap pin inserted through the hole in the end of the fulcrum 420. The pins 424 and pin stops 425 are so arranged that the fulcrum is limited to 15° rotation in either direction from the mid-point. Bolster 422 extends between proximal holes 431 in the legs 414. They are held in place by the snap pins 424 which extend through holes which are on the outside of the legs 414.

To assemble the embodiment of FIGS. 12, 13, and 14, the legs 414 are spread apart so that the fulcrum 420 with the guide ring 430 and the washers 427 attached may be placed in position and the legs are then closed with the fulcrum through the distal holes 429. Then the snap pins 424 are placed through the holes with the outer leg fitted in the notch 432. The ends of the fulcrum 420 are identical so that it is not necessary to observe a right and left side at time of assembly. After the fulcrum is in place the bolster 422 is threaded through the proximal holes 431 and a snap pin 424 placed through the holes in each of the ends of the bolster.

The washers 427 provide rigidity to the speculum 410 and prevent the legs of the speculum collapsing inward. Of course the legs are prevented from spreading outward by the four snap pins 424.

The embodiments shown and described above are only exemplary. I do not claim to have invented all the parts, elements or steps described. Various modifications can be made in the construction, material, arrangement, and operation, and still be within the scope of my invention.

For example, it might readily occur to other workers in the art that the ring guide similar to 30 could be mounted upon a pivoting bolster, particularly if the ring guide were spaced away from the bolster by posts or the like extension. Likewise the ring guide could be mounted upon a separate pivot rod mounted approximately between the fulcrum and the bolster.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. In a pharyngo-laryngeal compound speculum for animals having a. an inverted U-shaped mouth speculum including
   i. a bight,
   ii. two legs each extending to a distal end away from the bight,
   iii. a pole strap ring on each distal end,
   iv. a pole strap attached to the pole stop rings, and
b. spaced-apart transverse structures extending between the legs, designated as
   i. a fulcrum which is near the distal ends and
   ii. a bolster between the distal bar and the bight;

wherein the improvement comprises in combination with the above:

c. a cylindrical speculum guide attached to the mouth speculum between the fulcrum and bolster, and
d. a cylindrical speculum extending through the guide,
e. said guide forming a means for permitting the cylindrical speculum to be moved in a dorsoventral plane,
f. said transverse structures in the form of cross bars, and
g. said cylindrical speculum guide form of a ring attached to one of the cross bars having an axis which is pivoted to the legs for limited rocking about the axis of the cross bar.

* * * * *